US005637869A

United States Patent [19]

Bergmann

[11] Patent Number: 5,637,869

[45] Date of Patent: Jun. 10, 1997

[54] DETECTOR FOR TIME-OF-FLIGHT MASS-SPECTROMETERS WITH LOW TIMING ERRORS AND SIMULTANEOUSLY LARGE APERTURE

[75] Inventor: Thorald Bergmann, Buchenweg 9a, 82441 Ohlstadt, Germany

[73] Assignees: Thorald Bergmann; Eva Martina Bergmann, both of Ohlstadt, Germany

[21] Appl. No.: 269,545

[22] Filed: Jul. 1, 1994

[30] Foreign Application Priority Data

Jul. 2, 1993 [DE] Germany ..... 43 22 104.1

[51] Int. Cl.[6] ..... H01J 49/40

[52] U.S. Cl. ..... 250/287; 250/397

[58] Field of Search ..... 250/287, 397

[56] References Cited

U.S. PATENT DOCUMENTS 4,472,631 9/1984 Enke et al. ..... 250/287
5,160,840 11/1992 Vestal ..... 250/287

FOREIGN PATENT DOCUMENTS 9219367 11/1992 WIPO .

OTHER PUBLICATIONS

P. Steffens, E. Niehuis, T. Friese, D. Greifendorf & A. Benninghoven, A time–of–flight mass spectrometer for static SIMS applications, J. Vac. Sci. Technol. a 3(3), pp. 1322–1325 (1985).

E.R. Williams, L. Fang & R.N. Zare, Surface induced dissociation for tandem time–of–flight mass spectromtry, International Journal of Mass Spectrometery and Ion Processes, 123 (1993) 233–241.

W.A. deHeer & P. Milani, Large ion vol. time–of–flight mass spectrometer with position –and velocity–sensitive detection capabilities for cluster beams, Rev. Sci. Instrum. 62(3), Mar. 1991, pp. 670–677.

M.M. Wolf & W.E. Stephens, A Pulsed Mass Spectrometer with Time Dispersion, Rev. Sci. Instr. 24 (1953) pp. 616–617.

M.D. Burrows, S.R. Ryan, W.E. Lamb, Jr. & L.C. McIntyre, Jr., Mass filter and focusing ion detector for use with time–of–flight velocity distribution measurments, Rev. Sci. Instrum. 50(10), Oct. 1979, pp. 1278–1284.

*Primary Examiner*—Jack I. Berman
*Attorney, Agent, or Firm*—William H. Murray; Robert E. Rosenthal

[57] ABSTRACT

Ions passing through inhomogeneous electric fields in the detector of a time-of-flight mass-spectrometer may need different times on different paths(11) between the entrance aperture and the ion-electron conversion surface(3). These errors in flight time can be reduced by properly deforming the conversion surface(3).

11 Claims, 3 Drawing Sheets

DETECTOR FOR TIME-OF-FLIGHT MASS-SPECTROMETERS WITH LOW TIMING ERRORS AND SIMULTANEOUSLY LARGE APERTURE

BACKGROUND OF THE INVENTION

1. Field of the Invention

This invention relates to detectors used in time-of-flight mass-spectro-meters having some kind of ion-electron conversion surface.

Detectors for time-of-flight mass-spectrometers should oppose the in-coming beam with an aperture as large as possible and even with this large aperture they should cause as little timing errors as possible.

Every detector must have some kind of ion-electron conversion surface. At the instant that an ion impinges on that surface there is a certain probability that one or more electrons are created, which are amplified in electron-amplifiers. This amplification has as result an electrical impulse that gives information about the time-of-arrival of that ion.

As an alternative to electron-amplifiers a combination of scintillator and photomultiplier can also be used.

The ion optical axis is understood as one path, said path selected at or close to the center of the incoming ion beam. Should the detector have a construction of cylindrical symmetry, then usually the axis of symmetry is chosen.

Starting from the ion-electron conversion surface, one can follow the ion optical axis in reverse direction out of the detector up to a conveniently chosen point. Normal to the ion optical axis one can define a reference plane. As reference-time-of-flight one can define the time-of-flight from that reference plane onto the ion-electron conversion surface. If ions are started from the reference plane at other points than the axis point but with the same direction and velocity, these ions may need different flight times than an ion started on the axis point would need. The difference between these flight times and the reference-time-of-flight are called time errors.

These time errors can be given as a function of the starting location on the reference plane. In the most general case the time errors are a function of the two variables or parameters defining the reference plane. If the detector is constructed with rotational symmetry around a straight axis, the time errors are a function of the distance a path has from the ion optical axis in the reference plane.

Within a detector having inhomogeneous electrical fields ions can either he focused onto a smaller surface or defocused onto a larger surface. For that reason the usable surface on the ion-electron conversion surface is not a good measure for the sensitivity of the detector. As a measure of sensitivity one can use the size of that portion of the reference plane from which ions can be started with acceptably low timing errors into the detector.

By defining a reference plane and just considering the paths from the reference plane to the ion-electron conversion surface one can logically separate the detector and its timing errors from the rest of the time-of-flight mass-spectrometer. On the other hand, it is also possible to determine the timing errors of complete paths from the ion source to the conversion surface. Aside from timing errors that result directly from the detector and its construction, the paths may have timing errors in the ion source and the reflector that can be compensated by tilting the ion-electron conversion surface.

For that reason the conversion surface is often supported such that its orientation can he varied under operating condition.

2. Description of the Related Art

The main types of conversion surfaces in present use are:

- a metal surface on which ions release electrons with a certain probability after impinging. The metal surface may have a special coating to increase the probability of releasing electrons.
- the front surface of a microchannel plate. Actually the ions do
- penetrate some 10 μm deep into the channels before releasing electron. In this spirit the conversion surface really has a very complex form. For the discussion that follows the front surface of the microchannel plate will be equated to the conversion surface. The penetration of ions into the channels will not be considered any more, because these few 10 μm can be neglected compared to the other timing errors involved.

The probability of releasing electrons on the ion-electron conversion surface strongly depends on the velocity with which an ion hits the surface. Since the velocity is inversely proportional to the square root of the mass, the probability of detection falls off strongly for ions of higher mass.

Thus, to detect ions of high mass, it is mandatory to postaccelerate these ions before they hit the ion-electron conversion surface. Then they will release electrons with a sufficiently high probability when impinging on the surface. The detector must have a sufficiently high accelerating field in front of its conversion surface. This high postaccelerating field can be the source of timing errors.

It is usual practice to keep the timing errors small by making the postaccelerating field homogeneous. The direction and magnitude of a homogeneous electrical field is independent of location. In a detector with homogeneous electrical fields the time-of-flight from the reference plane to the ion-electron conversion surface is independent from where in the reference plane the ion is started. The time-of-flight is also independent of the location where the ion enters the postaccelerating field.

Such an electrical field can only he produced by separating the drift space of the time-of-flight mass-spectrometer from the postaccelerating field by an electrically conducting mesh. An example of such a detector can he seen in FIG. 5 of the publication by de Heer et al. (Review of Scientific Instruments, volume 62(3), page 670–677, 1991).

Ions entering the detector can also hit the lines of the mesh. As long as these ions are just removed from the ion beam, this will only cause a slight reduction in signal-output from the detector. However, there are several possibilities, that ions hitting the mesh lines cause an output-signal from the detector at incorrect times:

- Ions can be scattered inelastically on the mesh lines. If their path continues toward the conversion surface they may arrive at incorrect times,
- Ions can be scattered under large angles from the mesh lines, which also changes the velocity component toward the conversion surface.
- Ions can hit the mesh lines and break into pieces upon impact. These pieces can also arrive at incorrect times on the ion-electron conversion surface.

If, because of the above named problems, it is necessary to omit the meshes, the postaccelerating field will necessarily be inhomogeneous. This causes ions on different paths to strike the ion-electron conversion surface after different flight times.

As already mentioned, the magnitude of the time errors are a function of the distance the ion path has from the ion optical axis. The variable in this function is to be taken as the distance to the ion optical axis in the reference plane, and not on the conversion surface. In the optimum case, i.e. when the conversion surface can be tilted, the magnitude of these time errors is proportional to the square of the distance to the ion optical axis.

If this is the case, and if the flight time errors should be small, one should let the ions enter the detector only close to the ion optical axis. This means starting the ions from the reference plane only close to the ion optical axis. It does not make a difference whether ion paths are focused onto a smaller area or defocused onto a larger area: measure for the sensitivity of the detector is the size of the area in the reference plane from which ions can be started with acceptably small flight time errors into the detector.

An example of this solution to the problem can be seen in the publication of Steffens et al. (Journal of Vacuum Science and Technology, volume A3(3), page 1322–1325, 1985). FIG. 4 of the PCT-Application WO 92/19367 also demonstrates this method of solving the problem. The disadvantage of these solutions lies in the fact, that only a comparativity small volume of the detector can be used, i.e. only a small area of the reference plane can be allowed to oppose the incoming ion beam. This will reduce the sensitivity of the detector.

SUMMARY OF THE INVENTION

Accordingly, it is the object of the invention to provide a detector for time-of-flight mass-spectrometers that will allow for a high sensitivity and at the same time allow for a high mass resolution.

In particular, it is the object of this invention, to provide a detector for time-of-flight mass-spectrometers that can oppose the ion beam with a large usable area of the reference plane and that also has low flight time errors.

The characterizing features of the invention are given in claim 1 and claim 3.

In accordance with the invention, the flight time errors caused by the inhomogeneous electrical field in the detector or even flight time errors arising for some reasons before the detector are compenated within the detector itself. This is done by placing into the detector a curved ion-electron conversion surface. The curvature will as a function of lateral position, vary the flight time of each path, i.e. will shorten or prolong it, in such a manner that the errors induced by the inhomogeneous field or the errors having arised for some reason before the detector, are compensated or for the least minimized. As an example, some path might have a longer flight time than other paths in a detector with a fiat conversion surface. The curvature of the conversion surface will shorten the flight time of this path, thus equalizing its flight time with the flight times of the other paths.

As an example of the method given in claim 9, the shape of the ion-electron conversion surface can be determined as follows:

1. Take some particular design of the postaccelerating optics. An example is shown in FIG. 1. For the beginning, assume it has, as shown in FIG. 1, a flat ion-electron conversion surface.

2. Fix the electrode voltages: In this case only one ring electrode(1) is shown, which is to be at the potential of the drift space of the time-of-flight mass-spectrometer. The support(2) of the ion-electron conversion surface(3) is also fixed here to the postaccelerating potential U. The arrangement sad voltages of the electrodes create an inhomogeneous postaccelerating field in front of the conversion surface.

3. Determine a number of ion paths(11) subject to the following conditions:

All paths should start from a starting surface(12) normal to the axis of the detector.

All paths should start parallel to the axis of the detector with the same velocity into the detector.

All paths should be determined for exactly the same time-of-flight. Use as reference time that time which is necessary for an ion flying on the axis from the starting surface(12) to the conversion surface(3).

4. The endpoint of the axis path is on the middle of the conversion surface. The endpoints of the off-axis paths then describe the necessary form(20) of the conversion surface. This is shown enlarged in FIG. 2.

5. Modify the form of the conversion surface in the design of the detector according to the previous step and continue with step 3.

Changing the shape of the conversion surface changes the electrical field and with that also the fright time errors. For that reason the above procedure should be repeated until the flight time errors fall below some predetermined limit.

It is also possible to specify the form of the conversion surface as a power series of finite order. This implies not taking over the exact form of the surface determined in step 5 but just approximating that surface as close as possible, and then continuing with that approximation in step 3.

Instead of using the paths(11) determined in step 3 it is also possible to use paths with starting conditions corresponding to the actual operation of the time-of-flight mass-spectrometer, i.e. starting paths out of the ion source of the mass-spectrometer. In principle, this means that also time errors, as they arise in the ion source and the other parts of the time-of-flight mass-spectrometer, are also included into determining the curvature of the ion-electron conversion surface. In determining the end surface(20) one should take into consideration the fact that the space of initial variables has 6 coordinates in that case, 3 initial velocities and 3 initial coordinates. Since the end surface(20) is described by 2 parameters in B-dimensional space, it is necessary to approximate the end points of the paths(11) by the end surface(20) in such a way as to minimize the average distance of the endpoints of the paths(11) to the end surface (20).

As an alternative method, one can first fix the shape of the detector electrodes, also fixing the shape of the ion-electron conversion surface. After fixing the shape the electrode voltages should be varied until the time errors fall below some predetermined limit. This method corresponds to claim 10.

DESCRIPTION OF THE PREFERRED EMBODIMENTS

Figure 1:
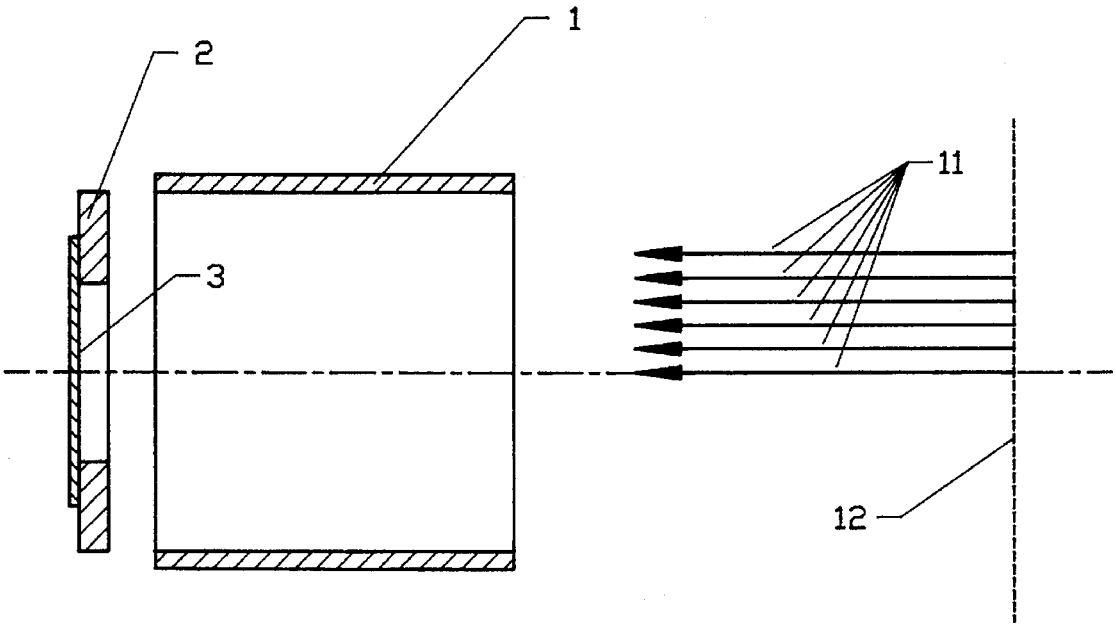
FIG. 1 shows the concept of a detector for time-of-flight mass-spectrometers, with ion paths starting from a reference plane into the detector.
Figure 2:
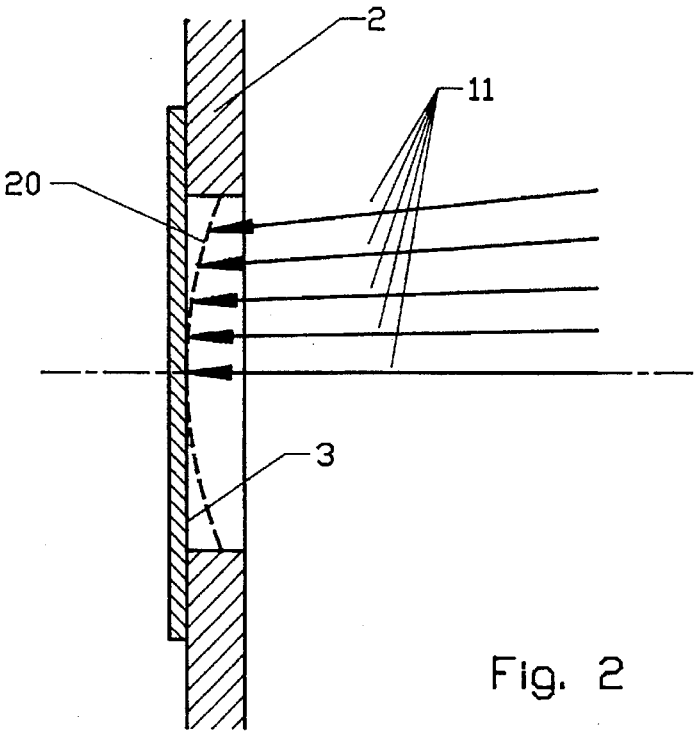
FIG. 2 shows the principle by which the shape of the ion-electron conversion surface can be determined.
Figure 3:
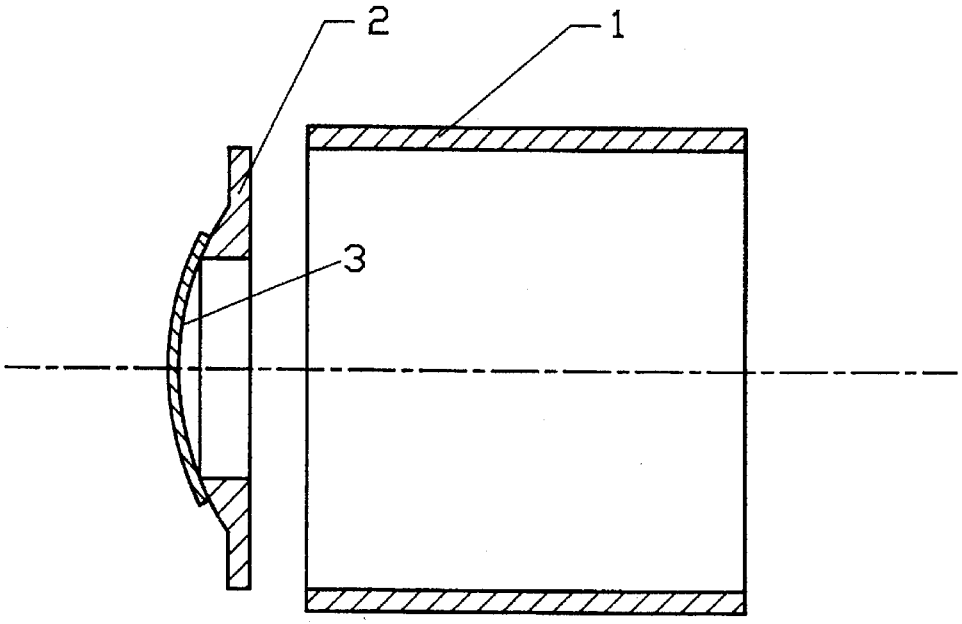
FIG. 3 shows the most basic embodiment of invention.

FIG. 3 shows the most basic implementation of a detector in accordance with the invention. This implementation compensates the time errors on off-axis paths with a curved conversion surface(3). As in FIG. 1, the only ring electrode (1) has the potential of drift space.

An implementation where the conversion surface(3) has a mount(2) such that it can he tilted corresponds also to claim 7. By tilting the mount is is possible to compensate within the detector some flight time errors of the ion source, the reflector and/or the drift space of the time-of-flight mass-spectrometer.

Figure 4:
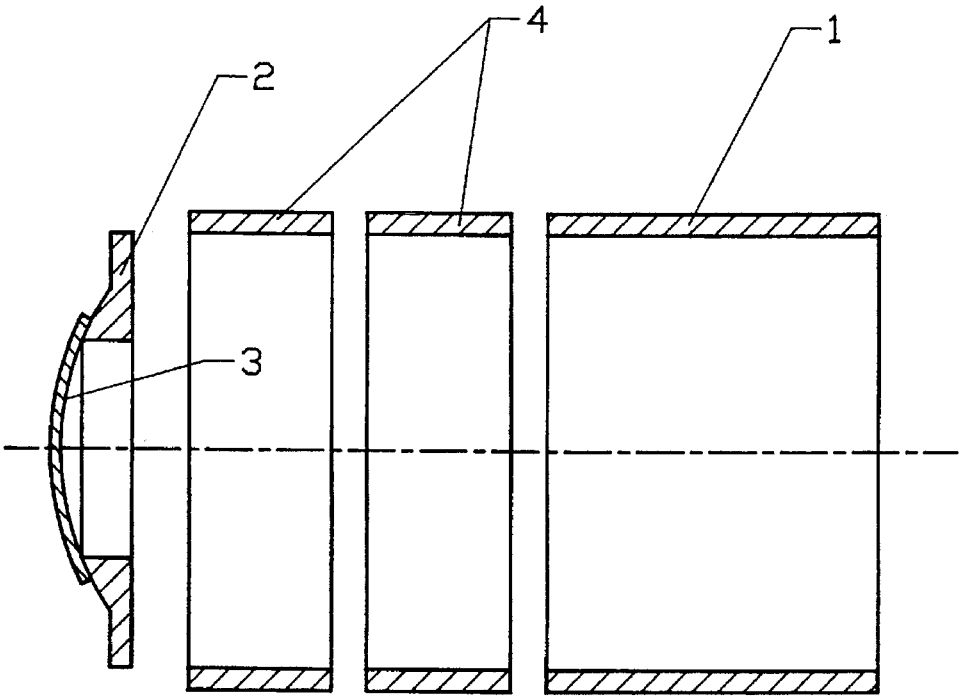
FIG. 4 shows a more advanced embodiment of invention. This embodiment allows higher post-acceleration voltages.

FIG. 4 shows an implementation with additional ting electrodes(4) to adjust the electrical field of the postacceleration space. In this manner the curvature necessary for the conversion surface(3) at some fixed value of the postaccelerating voltage can be kept lower as in the implentation shown in FIG. 3. As an alternative it is possible to work with higher postaccelerating voltages at the same curvature of the ion-electron conversion surface(3).

The additional ring electrodes(4) reduce flight time errors on off-axis paths by moving regions of high field curvature into places where the velocity of the ions is already higher. The potentials of the ring electrodes have values between the potential of the drift space and the potential of the ion-electron conversion surface(3). Instead of using two or more additional ting electrodes(4) it is also possible to use just one additional ring electrode.

With increasing postaccelerating potential the flight time errors become larger. In addition to that, the ion paths are more strongly bent toward the ion optical axis. Both of these effects necessitate that the curvature of the ion-electron conversion surface increases with increasing postaccelerating potential. At some value of the postaccelerating potential, where the ion paths are so strongly bent toward the ion optical axis that they meet at the center of the conversion surface, it is no longer possible to compensate the flight time errors by curvature of the conversion surface. This becomes again possible at still higher postaccelerating potentials, when ion paths cross before hitting the conversion surface.

Figure 5:
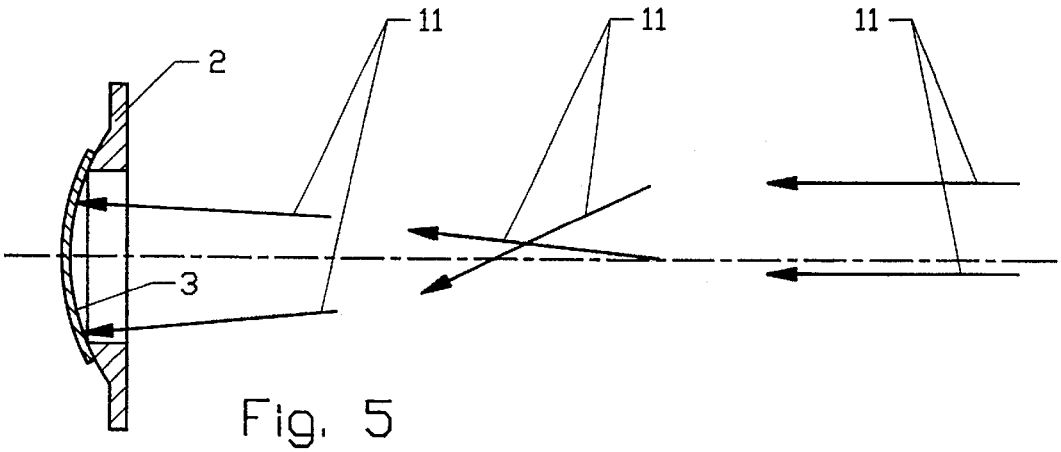
FIG. 5 shows how paths can be made to cross before the ions hit the ion-electron conversion surface. Operating a detector in this mode allows very high post-acceleration voltages.

If it is necessary that the detector has a large postaccelerating potential, it is advantageous, as shown in FIG. 5, to operate it corresponding to claim 8. This mode of operation allows any high postaccelerating potential at comparitively low curvature of the ion-electron conversion surface(3). This is done by convenient placement of the electrodes and adjustment of their voltages such that the ion paths(11) cross before the conversion surface. Since there is quite a number of electrode arrangements and voltages to produce an electrical field with the necessary properties, an explicit electrode construction is not shown here.

Figure 6:
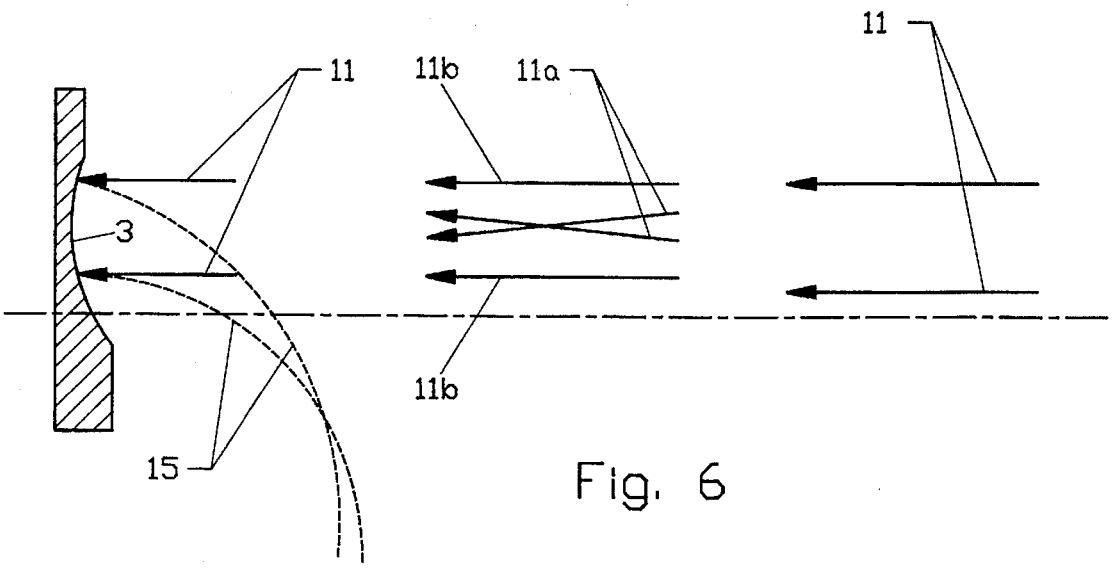
FIG. 6 shows a possibility of extracting electrons created at the ionelectron conversion surface.

FIG. 6 shows a detector construction according to claim 6. The electrons created at the curved ion-electron conversion surface(3) are drawn off to the side by some electrical field superposed over the postaccelerating field. The electron paths(15) are shown as dashed lines.

The ion paths(11) are shown twofold in the middle part of the postaccelerating region. The reason is, that similar to FIG. 5, it is possible to effect crossing(11*a*) paths or paths that are for the most part parallel(11*b*) down to the ion-electron conversion surface(3). The electrodes for post-acceleration of the ions need not be rotationally symmetric.

Since the field that draws out the electrons will break the rotational symmetry of the arrangement, the optimum curvature of the conversion surface may also not be rotationally symmetric. The detection of the electrons produced can be done by multichannel plate, scintillator or the like.

I claim:

1. A detector for time-of-flight mass-spectrometers,
with one or several electrodes(1,2,4) for postaccelerating ions, and
with an ion-electron conversion surface(3),
characterized by
an ion-electron conversion surface(3), which is not flat,
the curvature of the ion-electron conversion surface(3) reducing flight-time errors of the ions.

2. A detector according to claim 1, characterized by an ion-electron conversion surface(3), that is manufactured from metal.

3. The detector of claim 1,
wherein said conversion surface comprises a microchannel plate.

4. A detector according to claim 3, characterized by electrodes(1,2,4) for the postacceleration of ions that have rotational symmetry and an ion-electron conversion surface (3) that has rotational symmetry.

5. A detector according to claim 3, characterized by electrodes(1,2,4) for postacceleration of ions that are not rotationally symmetric and/or an ion-electron conversion surface(3) that is not rotationally symmetric.

6. A detector according to claim 1, characterized by an electric field for drawing out the electrons which are created at the ion-electron conversion surface(3) and that said field is superposed over the postacceleration field.

7. A detector according to claim 1, further comprising a mount, said ion-electron conversion surface(3) being tiltably supported on said mount.

8. A method of operating a detector of a time-flight mass spectrometer, that
has a number of electrodes (1, 2, 3) for postaccelerating ions, said electrodes defining an ion optical axis, comprising the steps of:
(a) providing an ion-electron conversion surface (3) that is not flat,
the curvature of the ion-electron conversion surface (3) reducing flight-time errors of the ions, and
(b) bending the off-axis ion paths (11) so strongly toward the ion optical axis that said ions cross the axis prior to striking the ion-electron conversion surface.

9. A detector for time-of flight mass-spectrometers, comprising
one or more electrodes for post accelerating ions, said electrodes having a preselected configuration, and defining an ion optical axis, and
a curved ion-electron conversion surface, the curvature of said surface being determined by the steps of:
a) selecting a preliminary form for the ion-electron conversion surface (3),
b) selecting the voltages of said electrodes (1,2,4)
c) determining the potential from the preselected configuration of the electrodes and the selected voltages,
d) determining a number of paths (11) into the detector, either
starting from a reference plane (12) normal to the ion optical axis, parallel to the ion optical axis with the same initial velocity, or
starting from the ion source of the time-of-flight mass spectrometer, having initial conditions corresponding to normal operation of the mass spectrometer;

e) calculating the flight time of an ion moving on the ion optical axis from the reference plane (12) to the selected preliminary form of conversion surface (3), f) determining the end point of each of said paths using the calculated flight time, and g) defining the surface (20), in case of two dimensional initial conditions for the determined paths, as a plane intersecting the determined endpoints of the previously determined paths (11), in case of more than two dimensional initial conditions for the determined paths, as a plane most closely approximating all the determined endpoints of the previously determined paths (11).

10. A detector for time-of-flight mass-spectrometers, comprising a curved ion-electron conversion surface, and one or more electrodes having selected voltages, said selected voltages being determined by the steps of:

a) selecting the forms of the electrodes (1,2,4), b) selecting a preliminary set of voltages for the electrodes, c) determining the potential from the electrode-forms and voltages given, d) determining a number of paths (11) into the detector, either starting from a reference plane (12) normal to the ion optical axis, parallel to the ion optical axis with the same initial velocity, or starting from the ion source of the time-of-flight mass spectrometer, choosing paths with initial conditions corresponding to normal operation of the mass spectrometer;

e) selecting a flight time equal to the time that an ion needs to travel from the reference plane (12) to the conversion surface (3), said ion flying on the ion optical axis;

f) using said flight time to determine an end point of each of said paths;

g) modifying the electrode voltages so as to minimize the difference between a surface defined by the endpoints of the ion paths (11) and the ion-electron conversion surface (3).

11. The detector of claim 10, wherein said curvature is determined by the following steps following said step g):

approximating the form of the ion-electron conversion surface determined in said step g) by an expansion defined by a finite number of parameters, and repeating said steps c) through g) until the difference between the surface determined in said step g) and the actual conversion surface falls below a predetermined limit.

* * * * *